US008493164B2

(12) United States Patent
Kurihara et al.

(10) Patent No.: US 8,493,164 B2
(45) Date of Patent: Jul. 23, 2013

(54) ELECTROMAGNETIC RELAY

(75) Inventors: Daisuke Kurihara, Shinagawa (JP); Akihiko Nakamura, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/465,259

(22) Filed: May 7, 2012

(65) Prior Publication Data

US 2012/0293285 A1 Nov. 22, 2012

(30) Foreign Application Priority Data

May 18, 2011 (JP) ..... 2011-111445

(51) Int. Cl.
*H01H 51/22* (2006.01)

(52) U.S. Cl.
USPC ..... 335/78

(58) Field of Classification Search
USPC ..... 335/78
See application file for complete search history.

(56) References Cited

U.S. PATENT DOCUMENTS

| | | | | |
|---|---|---|---|---|
| 5,880,653 | A * | 3/1999 | Yamada et al. | 335/78 |
| 6,784,773 | B2 * | 8/2004 | Tsutsui et al. | 335/78 |
| 8,072,300 | B2 * | 12/2011 | Sako et al. | 335/80 |
| 2002/0057147 | A1 * | 5/2002 | Shinoura et al. | 335/78 |
| 2005/0046527 | A1 * | 3/2005 | Chida et al. | 335/78 |
| 2007/0194866 | A1 * | 8/2007 | Mikl | 335/78 |
| 2010/0315184 | A1 * | 12/2010 | Morimoto et al. | 335/209 |

FOREIGN PATENT DOCUMENTS

JP 2000-215775 8/2000

* cited by examiner

*Primary Examiner* — Alexander Talpalatski
(74) *Attorney, Agent, or Firm* — Staas & Halsey LLP

(57) ABSTRACT

An electromagnetic relay includes an electromagnetic relay body having an electromagnet and a contact part, the contact part opening and closing along with movement of the electromagnet, a terminal member supporting the electromagnetic relay body, and a base member supporting the terminal member. The terminal member has a connecting part electrically connected to the electromagnetic relay body, the electromagnetic relay body is supported by the connecting part while providing a clearance between the base member and the electromagnetic relay body.

10 Claims, 8 Drawing Sheets

ELECTROMAGNETIC RELAY

BACKGROUND OF THE INVENTION

1. Field of the Invention

The present invention relates to an electromagnetic relay which has a noise suppressing function.

2. Description of the Related Art

Conventionally, electromagnetic relay designed to reduce the operating noise occurred at the time of opening and closing operations of the relay contact is known. In the electromagnetic relay described in Japanese Unexamined Patent Publication No. 2000-215775 (JP2000-215775A), the electromagnetic relay is provided with an inner case in which the electromagnetic relay body is housed, an outer case which covers the outer circumference of the inner case, and a relay terminal plate which is arranged between the inner case and the outer case, has one end which is connected to the terminal parts at the surface of the inner case, and has another end which sticks out from the outer case to form external terminals, the relay terminal plate being provided with concave and convex portions which are used to reduce vibration due to relay operating noise.

However, the electromagnetic relay described in JP2000-215775A has a double case structure of an inner case and an outer case, so the reverberating sound at the time of relay operation becomes larger and a sufficient noise suppression effect can not be obtained. Further, the heat radiating ability of the contact, coil, and other heat generating parts also deteriorate.

SUMMARY OF THE INVENTION

According to one aspect of the present invention, the electromagnetic relay is provided with an electromagnetic relay body which has an electromagnet and a contact part, the contact part opening and closing along with movement of the electromagnet, a terminal member which supports the electromagnetic relay body, and a base member which supports the terminal member, wherein the terminal member has a connecting part electrically connected to the electromagnetic relay body, and the electromagnetic relay body is supported by the connecting part while providing a clearance between the base member and the electromagnetic relay body.

BRIEF DESCRIPTION OF THE DRAWINGS

The objects, features, and advantages of the present invention will become more apparent from the explanation of the embodiments below given with reference to the attached drawings, in which.

DETAILED DESCRIPTION

First Embodiment

Figure 1:
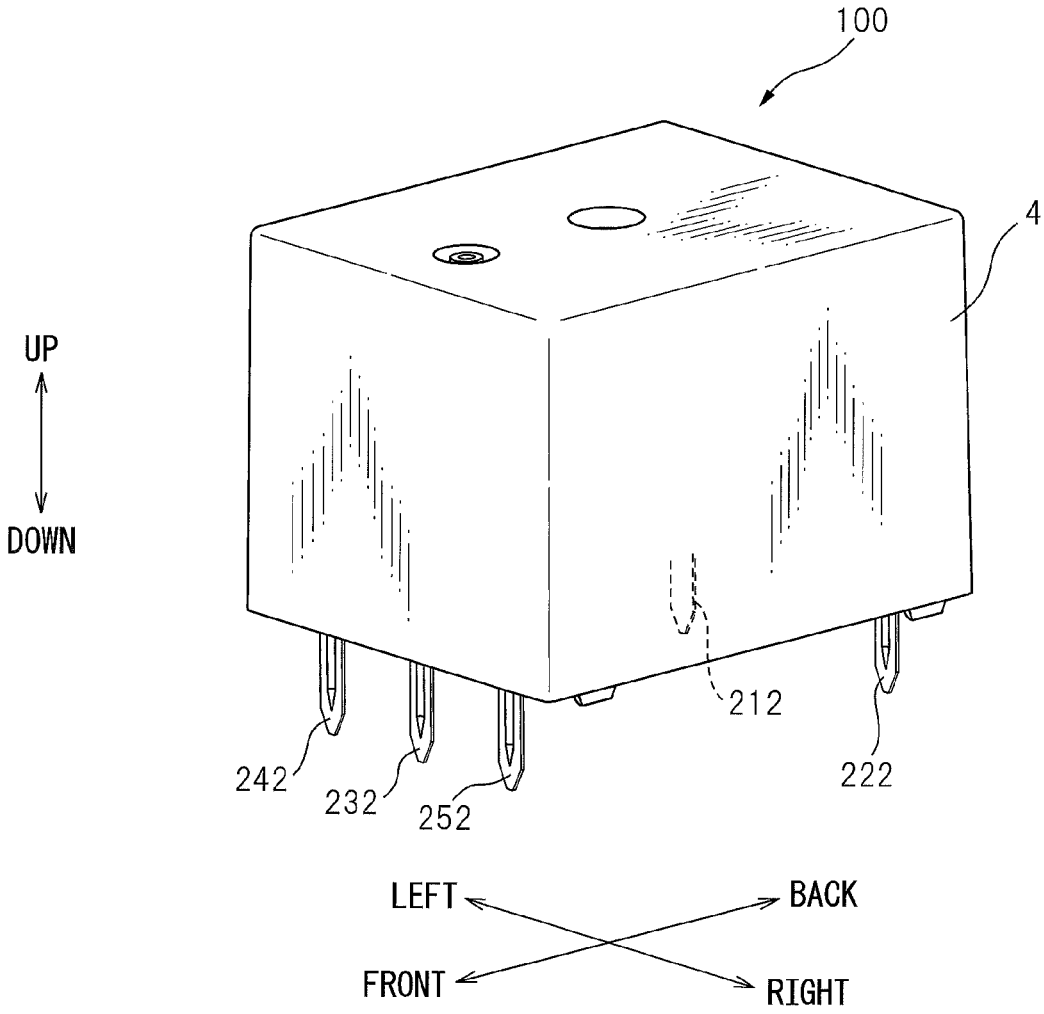
FIG. 1 is a perspective view of the appearance of an electromagnetic relay according to a first embodiment of the present invention.
Figure 2:
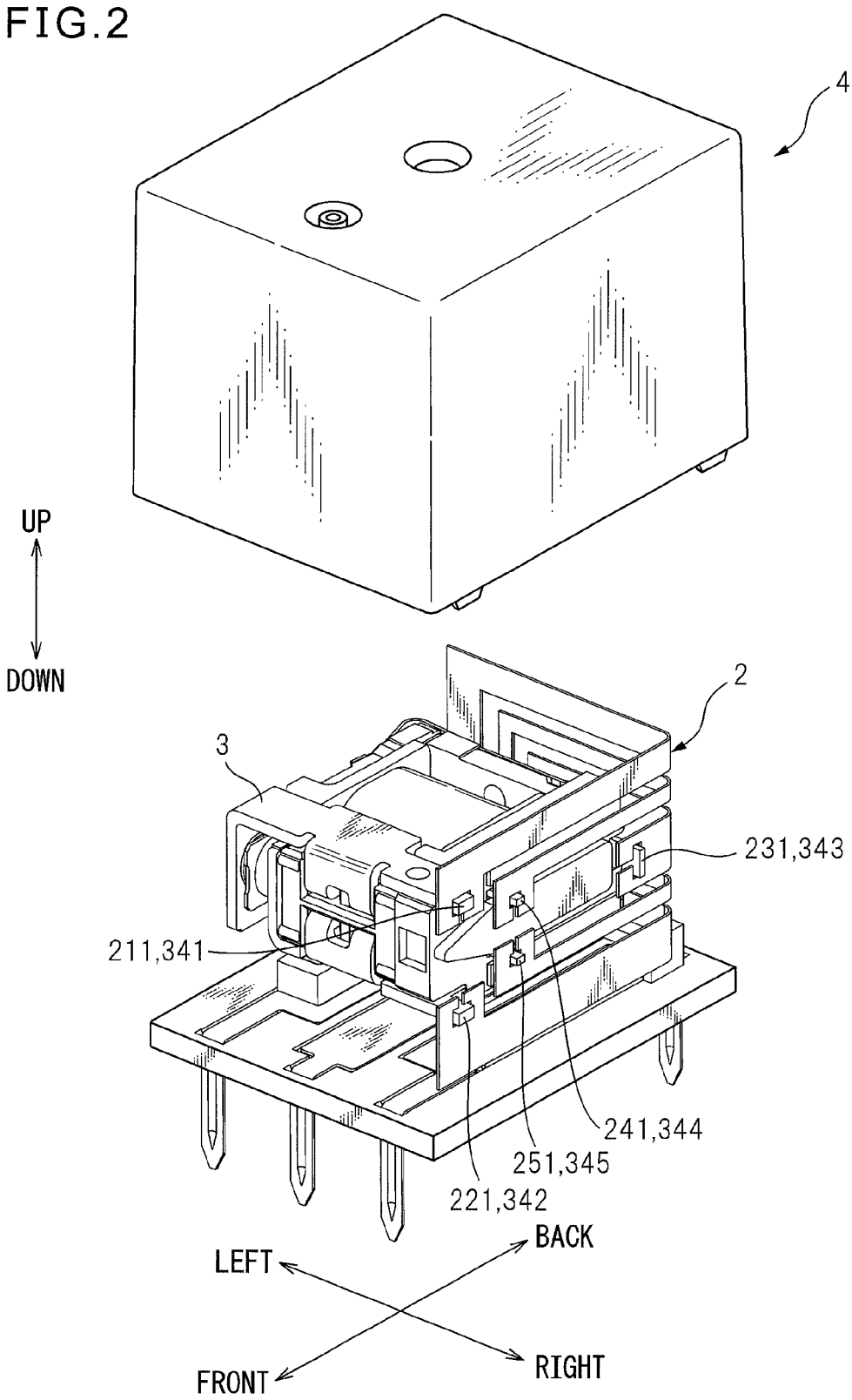
FIG. 2 is a cross-sectional view which shows an internal configuration of the electromagnetic relay according to the first embodiment of the present invention.
Figure 3:
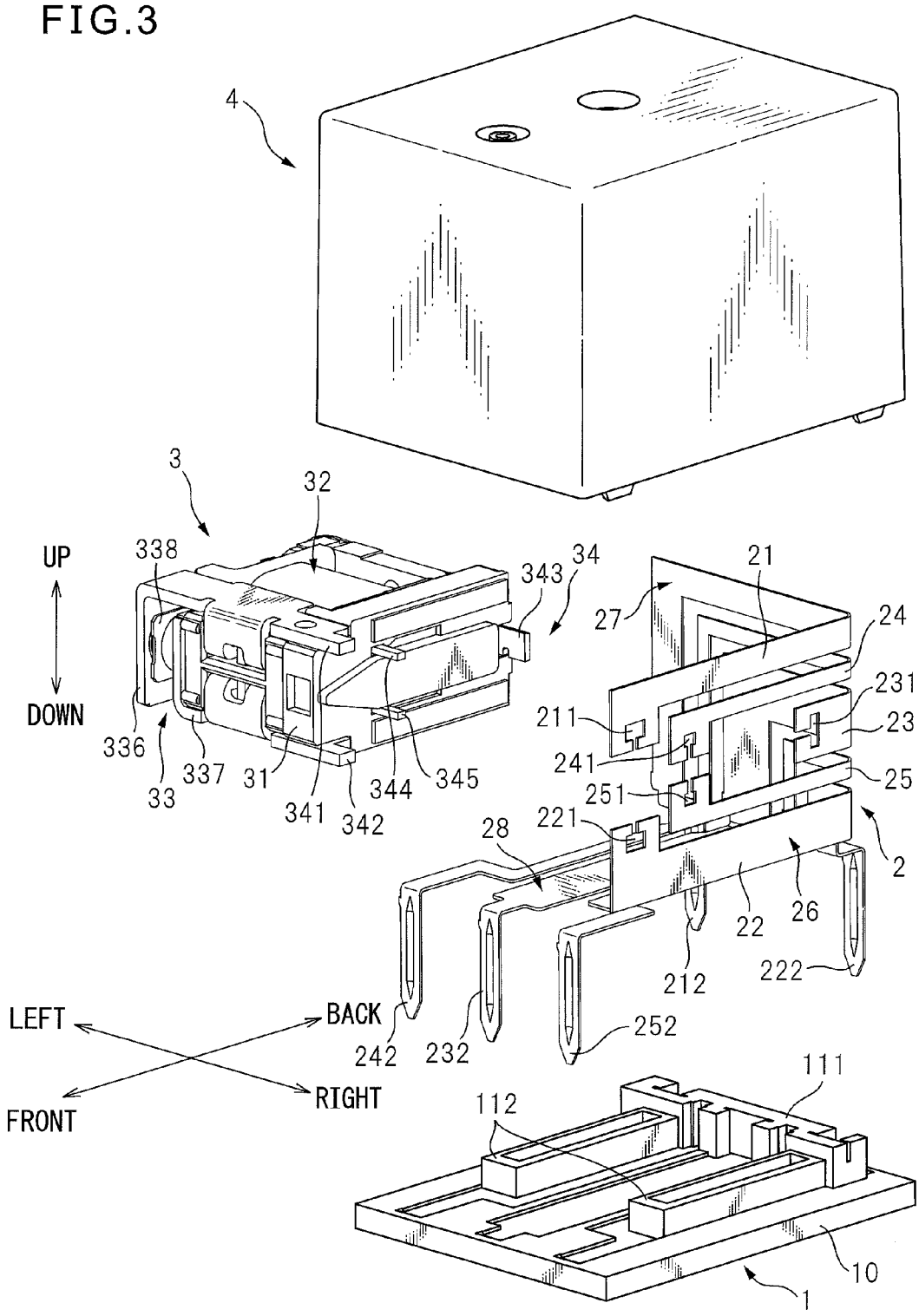
FIG. 3 is a disassembled perspective view of the electromagnetic relay according to the first embodiment of the present invention.

Below, referring to FIG. 1 to FIG. 6, a first embodiment of the present invention will be explained. FIG. 1 is a perspective view which shows the appearance and structure of an electromagnetic relay according to a first embodiment of the present invention 100, FIG. 2 is a perspective view which shows the internal configuration of the electromagnetic relay, and FIG. 3 is a disassembled perspective view of the electromagnetic relay. Note that, below, for convenience, the front-back and left-right directions and the up-down direction are defined as illustrated. The configuration of the parts will be explained in accordance with these definitions.

As shown in FIG. 3, the electromagnetic relay 100 according to the present embodiment has a base member 1, a terminal member 2 which is assembled into the base member 1, a relay body 3 which is supported by the terminal member 2, and a cover 4 which is attached to the base member 1 and surrounds the terminal member 2 and the relay body 3 at the top of the base member 1.

Figure 4A:
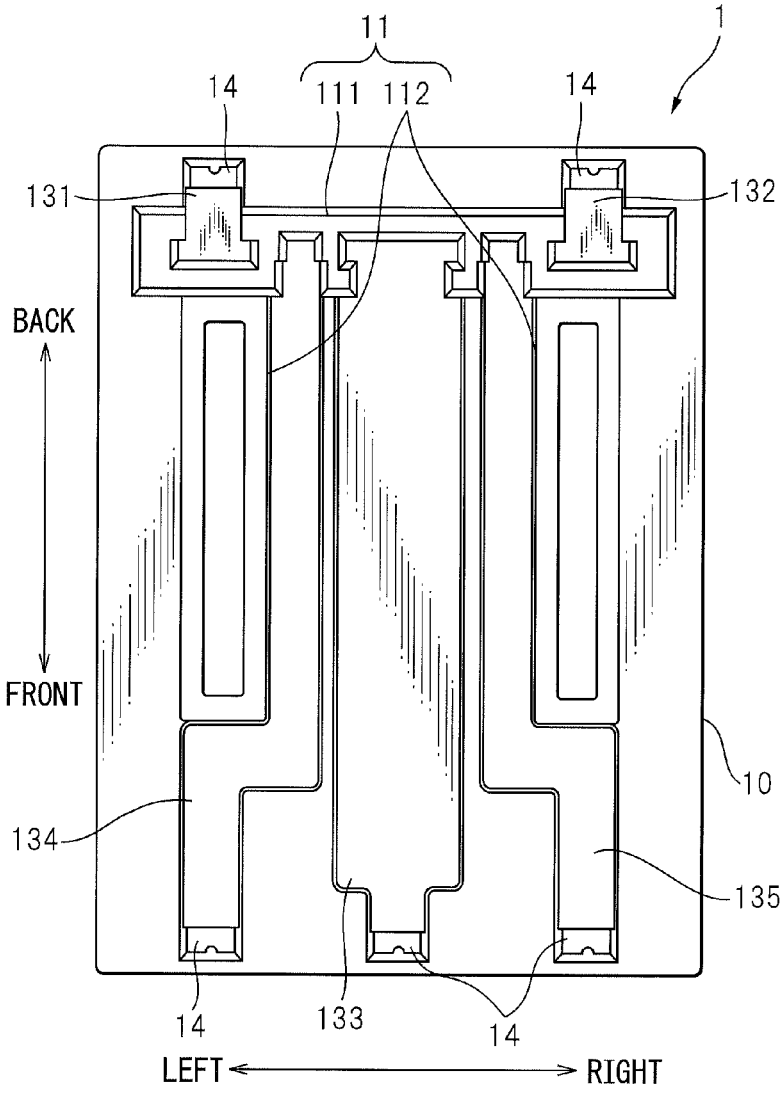
FIG. 4A is a plan view of a base member of FIG. 3.
Figure 4B:
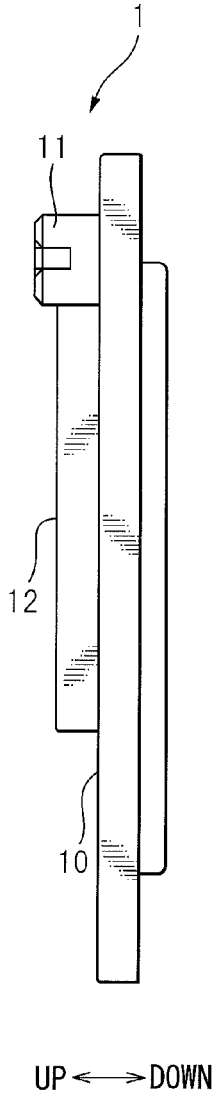
FIG. 4B is a side view of the base member of FIG. 3.

FIG. 4A and FIG. 4B are a plan view and side view of the base member 1. As shown in FIGS. 3, 4A, and 4B, the base member 1 has a plate-shaped base part 10 of a substantially rectangular shape when viewed by a plan view and a protruding part 11 of a substantially U-shape when viewed in a plan view, and the protruding part 11 is provided sticking upward from the top surface of the base part 10. The base member 1 is symmetrical in shape to the left and right and is formed integrally by plastic molding. The protruding part 11 has a first protruding part 111 of a substantially block shape which extends at a back end portion of the top surface of the base part 10 in the left-right direction, and a pair of left and right second protruding parts 112 of substantially block shapes which extend from the two left and right end portions of the front surface of the first protruding part 111 toward the front. The height of the top surface of the first protruding part 111 is higher than the heights of the top surfaces of the second protruding parts 112.

At the top surface of the base part 10, a pair of left and right shallow grooves 13 (first shallow groove 131 and second shallow groove 132) are formed from the center part of the first protruding part 111 in the front-back direction toward the back end portion of the base part 10. Further, three shallow grooves 13 (fourth shallow groove 134, third shallow groove 133, and fifth shallow groove 135) are formed from the center of the first protruding part 111 in the front-back direction toward the front end portion of the base part 10. The heights of the bottom surfaces of these shallow grooves 131 to 135 are mutually equal.

The first shallow groove 131 and the second shallow groove 132 extend on substantial extensions of the left and right second projecting parts 112 by respectively certain widths (left-right direction lengths). The fourth shallow groove 134 and the fifth shallow groove 135 are formed by respectively certain widths along the left and right inner surfaces and front surface of the second protruding parts 112, and form substantially crank shapes when viewed by a plan view. The third shallow groove 133 extends between the fourth shallow groove 134 and the fifth shallow groove 135 in the form of a straight line in the front-back direction. The third shallow groove 133 is broader in width than the fourth shallow groove 134 and the fifth shallow groove 135, and becomes narrower in width near the front end portion of the base part 10 so as to become a width of the same extent as the fourth shallow groove 134 and the fifth shallow groove 135. The widths of the first shallow groove 131 and the second shallow groove 132 are the same extent as the widths of the fourth shallow groove 134 and the fifth shallow groove 135.

The front ends of the first shallow groove 131 and the second shallow groove 132 are positioned on the same straight line in the left-right direction. The back ends of the third shallow groove 133, fourth shallow groove 134, and fifth shallow groove 135 are positioned on the same straight line in the left-right direction at the back from the front ends of the first shallow groove 131 and the second shallow groove 132. These first shallow groove 131 to fifth shallow groove 135 are formed so as to change in width like stepped shape at the inside of the first protruding parts 111 (left-right direction length). That is, the first shallow groove 131 and the second shallow groove 132 are enlarged in width, the fourth shallow groove 134 and the fifth shallow groove 135 are reduced in width, and the third shallow groove 133 is reduced in width once, then enlarged. The back end portions of the first shallow groove 131 and the second shallow groove 132 and the front end portions of the third shallow groove 133, the fourth shallow groove 134, and the fifth shallow groove 135 are provided with through holes 14 which pass through the base part 10 in the up-down direction.

Figure 5:
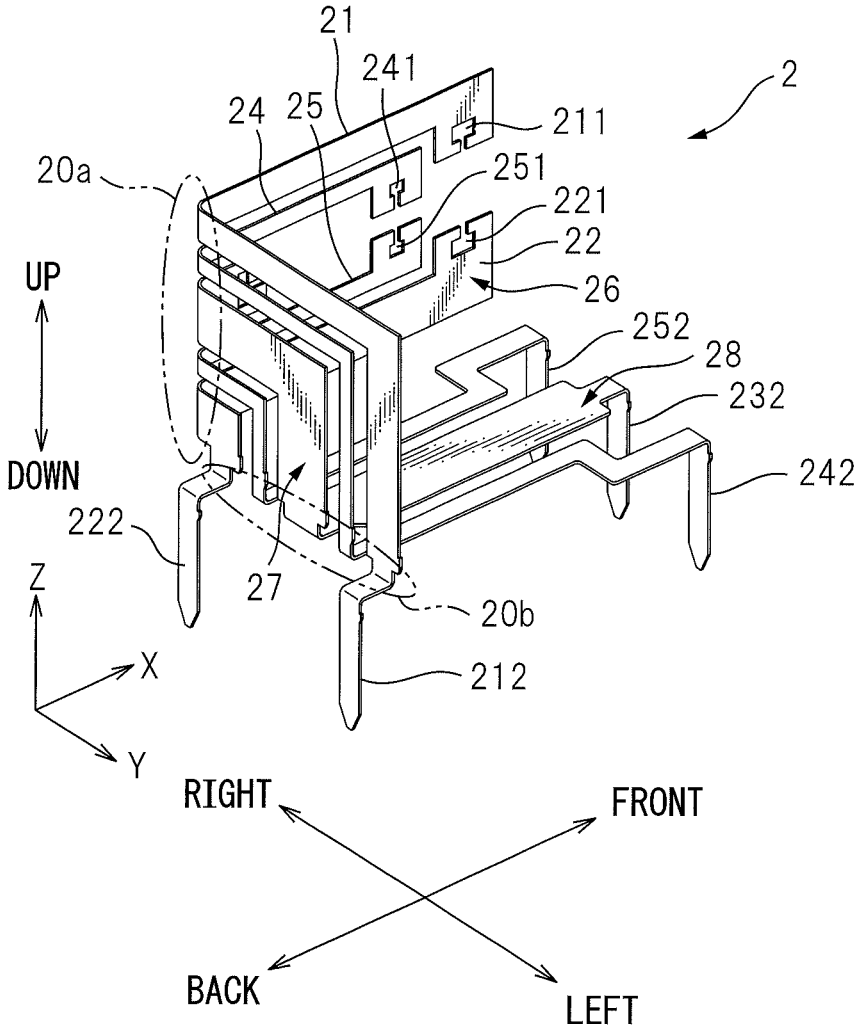
FIG. 5 is a perspective view of a terminal member of FIG. 3.

FIG. 5 is a perspective view of the terminal member 2 seen from a direction different from FIG. 3. As shown in FIGS. 3 and 5, the terminal member 2 is comprised of conductive plate members which are electrically connected to the relay body 3. It is comprised of mutually independent, elongated plate members (first plate member 21 to fifth plate member 25) in a number corresponding to the electrical connection parts (here, five). The plate members 21 to 25 have open parts 211, 221, 231, 241, and 251 which are electrically connected to the relay body 3 at one end portions and have external terminals of the electromagnetic relay 100 comprised of the terminal parts 212, 222, 232, 242, and 252 at the other end portions. In FIG. 5, when defining the front-back, left-right, and up-down directions as respectively the X-direction, Y-direction, and Z-direction, the plate members 21 to 25 are extended bent from the common XZ plane (right surface part 26) to the YZ plane (back surface part 27) and then to the XY plane (bottom surface part 28), and are further bent from the XY plane downward. That is, the terminal member 2 is formed along three mutually perpendicular planes. A bent part 20*a* is provided at the intersecting part of the XZ plane and the YZ plane, and a bent part 20*b* is provided at the intersecting part of the YZ plane and the XY plane.

The shapes of the plate members 21 to 25 will be explained in further detail. The plate members 21 to 25 extend in the XZ plane so that there is a clearance between adjoining plate members 21 to 25, and extend parallel with each other in the front-back direction by certain widths (up-down direction length). Furthermore, they extend parallel with each other at certain widths in the YZ plane, and then their direction is changed downward to extend downward while maintaining a certain clearance between the adjoining plate members 21 to 25. That is, the plate members 21 to 25 form substantially L-shapes in the YZ plane without contacting each other. The widths of the plate members 21 to 25 (lengths perpendicular to longitudinal direction) are determined in accordance with the type of a terminal part 34 of the relay body 3 which is electrically connected to the plate members 21 to 25 as explained later. The widths of the second plate member 22 and the third plate member 23 are the broadest, while the widths of the fourth plate member 24 and the fifth plate member 25 are the narrowest.

Among the plate members 21 to 25 which extend downward in the YZ plane, the first plate member 21 and the second plate member 22 at the two left and right sides are bent backward substantially perpendicularly at the bent part 20*b*, while the third plate member 23, the fourth plate member 24, and the fifth plate member 25 are bent forward substantially perpendicularly at the bent part 20*b*. The bent plate members 21 to 25 are extended in the XY plane without contacting each other. The ends of the plate members 21 to 25 are bent downward, whereby the terminal parts 212, 222, 232, 242, and 252 are formed.

As shown in FIG. 3, at the right surface part 26 of the terminal member 2, the front end portions of the first plate member 21 and the second plate member 22 are positioned at the forward end of the terminal member 2. The front end portions of the fourth plate member 24 and the fifth plate member 25 are positioned at the back of the front end portions of the plate members 21 and 22. The front end portion of the third plate member 23 is positioned at the back end side of the XZ plane. Projecting parts are formed at the front end portions of the first plate member 21 and the second plate member 22, projecting inward in the up-down direction, while projecting parts are also formed at the front end portions of the fourth plate member 24 and the fifth plate member 25, projecting inward in the up-down direction. These projecting parts are provided with substantially rectangular open parts 211, 221, 241, and 251. The front end portion of the third plate member 23 is also provided with a substantially rectangular open part 231. These open parts 211, 221, 231, 241, and 251 are provided corresponding to the terminal part 34 of the relay body 3 explained later, and the terminal part 34 of the relay body 3 is inserted into open parts 211, 221, 231, 241, and 251. To facilitate insertion of the terminal parts 34, slits are formed from the open parts 211, 221, 231, 241, and 251 to the end faces of the plate members 21 to 25.

The relay body 3 has a base block 31, an electromagnet 32 which is supported by the base block 31, a contact part 33 which opens and closes along with movement of the electromagnet 32, and a terminal part 34 which is provided sticking out from an end face of the base block 31. The relay body 3 forms overall a substantially block shape. The base block 31 is an electrically insulating plastic molded part which forms the base part of the relay body 3. However, in the present embodiment, the relay body 3 is placed laid down on its side and the bottom surface of the base block 31 is positioned facing the right surface part 26 of the terminal member 2.

Figure 6:
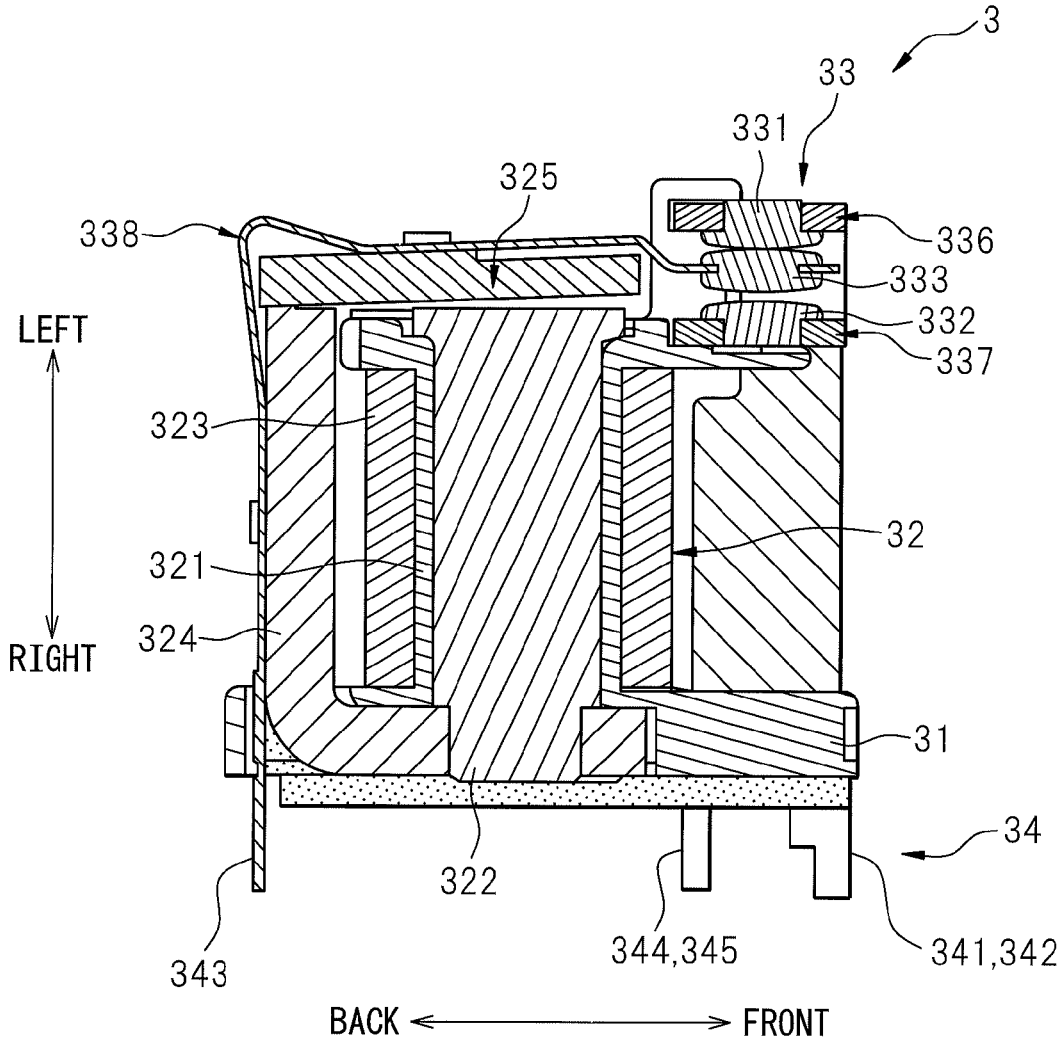
FIG. 6 is a cross-sectional view of a relay body of FIG. 3.

FIG. 6 is a cross-sectional view which shows the internal configuration of the relay body 3. Note that, in FIG. 6, the relay body 3 is shown in a standing state. If the relay body 3 of FIG. 6 is laid down 90 degrees to the front side of the paper surface, the state of FIG. 3 is obtained.

As shown in FIG. 6, the electromagnet 32 has a hollow spool 321 which is provided standing up on the base block 31, an iron core 322 which is housed inside of the spool 321, and a coil 323 which is attached to the circumferential surface of the spool 321. At the two end portions of the wire of the coil 323, a pair of terminals 344 and 345 used for the coil are connected. The terminals 344 and 345 pass through the base block 31 and stick out to the right. At the right end portion of the iron core 322, a yoke 324 is connected in a fixed manner. The yoke 324 is a rigid plate member with a cross-sectional L-shape which is formed from, for example magnetic steel, and extends behind the coil 323. At the left end portion of the yoke 324, the armature 325 is supported to be swingable in the left-right direction. The armature 325 is a rigid plate member which is formed from, for example magnetic steel, and is supported through a movable contact spring member 338 which is attached to the contact part 33 to the yoke 324 in a manner enabling elastic relative movement. When the electromagnet 32 operates, the iron core 322, yoke 324, and armature 325 form a magnetic circuit.

The contact part 33 has a first fixed terminal member 336 and a second fixed terminal member 337 which are arranged separated to the left and right and a movable contact spring member 338 which is arranged between the first fixed terminal member 336 and the second fixed terminal member 337. At the right surface of the end portion of the first fixed terminal member 336 and the left surface of the end portion of the second fixed terminal member 337, a first fixed contact 331 and a second fixed contact 332 are respectively provided projecting out from them. At the left and right surfaces of the end portion of the movable contact spring member 338, movable contacts 333 are provided projecting out from them. The first fixed contact 331, second fixed contact 332, movable contact 333, first fixed terminal member 336, second fixed terminal member 337, and movable contact spring member 338 are comprised of conductive metal materials.

As shown in FIG. 3, the first fixed terminal member 336 and the second fixed terminal member 337 are comprised of substantially L-shaped plate members which extend toward the base block 31. At the end portions (right end portions), terminal parts 341 and 342 used for the fixed terminals are formed extending beyond the base block 31. As shown in FIG. 6, the movable contact spring member 338 passes behind the yoke 324 and passes through the base block 31. A terminal part 343 used for the movable terminal is formed at the end portion (right end portion) of the movable contact spring member 338. The above terminal parts 341 and 342 used for the fixed terminals, terminal part 343 used for the movable terminal, and terminal parts 344 and 345 used for the coil constitute the terminal part 34 of the relay body 3.

In FIG. 3, the terminal parts 341 and 342 used for the fixed terminals are provided sticking out to the right from the top and bottom end portions of the front end of the relay body 3. The terminal part 343 used for the movable terminal is provided sticking out to the right from the center part of the back end of the relay body 3. The terminal parts 344 and 345 used for the coil are provided behind the fixed terminal-use terminal parts 341 and 342 and sticking out to the right from the inside in the up-down direction. That is, the terminal parts 341 to 345 correspond to the positions of the open parts 211, 221, 231, 241, and 251 of the terminal member 2, respectively.

The cover 4 forms a substantially box shape overall with an open bottom surface and is formed by plastic molding. The shape of the bottom surface of the cover 4 is substantially equal to the outer shape of the base member 1. The base member 1 can be attached to the inside surfaces of the cover 4.

The assembly procedure of the electromagnetic relay 100 according to the present embodiment will be explained. First, the terminal part 222 of the second plate member 22 is passed through the through hole 14 of the second shallow groove 132 of the base member 1 from above, and the bottom surface part 28 of the second plate member 22 is engaged with the second shallow groove 132 which is provided from the first protruding part 11 to the base part 10. Similarly, the terminal part 252 of the fifth plate member 25 is passed through the through hole 14 of the fifth shallow groove 135, the terminal part 232 of the third plate member 23 is passed through the through hole 14 of the third shallow groove 133, the terminal part 242 of the fourth plate member 24 is passed through the through hole 14 of the fourth shallow groove 134, and the terminal part 212 of the first plate member 21 is passed through the through hole 14 of the first shallow groove 131. Further, the bottom surface parts 28 of the fifth plate member 25, third plate member 23, fourth plate member 24, and first plate member 21 are engaged with the fifth shallow groove 135, third shallow groove 133, fourth shallow groove 134, and first shallow groove 131 which are provided from the first protruding part 11 to the base part 10. According to the above procedure, it is possible to assemble the terminal member 2 comprised of the plurality of the plate members 21 to 25 to the base member 1 without mutual interference of the plate members 21 to 25 at the right surface part 26, back surface part 27, and bottom surface part 28.

Next, as shown in FIG. 3, the relay body 3 is laid down on its side to make the bottom surface of the base block 31 face the right surface part 26 of the terminal member 2. In that state, the relay body 3 is moved toward the right surface part 26 and the terminal parts 341 to 345 of the relay body 3 are inserted into the open parts 211 to 251 of the terminal member 2. After this, the terminal parts 341 to 345 are soldered to fasten them to the open parts 211, 221, 231, 241, and 251 of the terminal member 2. Therefore, the terminal parts 341 to 345 of the relay body 3 are electrically connected to the plate members 21 to 25 of the terminal member 2 and, as shown in FIG. 2, the relay body 3 is supported, in a state with clearance from the top surface of the base member 1, through the terminal parts 341 to 345 in a cantilever manner at the right surface part 26 of the terminal member 2.

Finally, the base member 1 is covered by the cover 4 from the top, and a binder is used to fasten the cover 4 to the base member 1. Therefore, as shown in FIG. 1, the electromagnetic relay 100 is completed. This electromagnetic relay 100 is mounted on a board etc. whereby the terminal parts 212, 222, 232, 242, and 252 which stick out from the bottom surface of the electromagnetic relay 100 are electrically connected to an outside electrical part. For example, the terminal parts 212, 222, and 232 are connected to a power supply circuit for supplying power to the various electrical parts, while the terminal parts 242 and 252 are connected to a power circuit for supplying voltage to the coil 323.

The operation of the electromagnetic relay 100 according to the present embodiment will be explained next. If voltage is supplied from an outside power circuit to the terminal parts 242 and 252, current successively flows through the fourth plate member 24, terminal 344 used for the coil, coil 323, terminal 345 used for the coil, and fifth plate member 25 whereby the coil 323 is energized, and therefore, the electromagnet 32 operates. Due to the magnetic attraction force, the armature 325 is pulled against the spring force of the movable spring member 338 to the end face of the iron core 322, so that the movable contact 333 moves away from the first fixed contact 331 and abuts against the second fixed contact 332. As a result, a circuit is formed from the terminal part 222 to the second plate member 22, terminal part 342 used for the fixed terminal, second fixed contact 332, movable contact 333, terminal part 343 used for the movable terminal, third plate member 23, and terminal part 232.

On the other hand, when the supply of voltage to the terminal parts 242 and 252 is stopped, the coil 323 becomes de-energized. Therefore, the spring force of the movable spring member 338 causes the armature 325 to move away from the end face of the iron core 322, so that the movable contact 333 moves away from the second fixed contact 332 and abuts against the first fixed contact 331. As a result, a circuit is formed from the terminal part 212 to the first plate member 21, terminal part 341 used for the fixed terminal, first fixed contact 331, movable contact 333, terminal part 343 used for the movable terminal, third plate member 23, and terminal part 232.

When switching between activation and deactivation of the electromagnet 32 in this way, an operating noise is caused from the relay body 3. This operating noise is reduced when it is transmitted to the terminal member 2 and propagated through the plate members 21 to 25. In the present embodiment, the plate members 21 to 25 are formed long. Therefore, the operating noise of the relay body 3 can be sufficiently reduced inside of the terminal member 2 and can be kept from being transmitted through the base member 1 and the terminal parts 212, 222, 232, 242, and 252 to the outside. As a result, a sufficient noise suppression effect can be obtained.

According to the present embodiment, it is possible to obtain the following operation and effects.

(1) The terminal member 2 is attached to the base member 1, the terminal part 34 of the relay body 3 is connected to the terminal member 2, and thereby the relay body 3 is supported while providing a clearance from the base member 1. Therefore, operating noise which is produced at the relay body 3 is not directly transmitted to the base member 1, and the terminal member 2 can reduce the operating noise. Therefore, a sufficient noise suppression effect can be exhibited. In this case, as the relay body 3 is covered by a single cover 4, the reverberating sound can be reduced and the heat radiating ability can also be raised, compared with a double cover structure relay.

(2) The terminal member 2 is comprised of the plurality of plate members 21 to 25 corresponding to the terminal part 34 of the relay body 3, and open parts 211 to 251 are provided at the end portions of the plate members 21 to 25. Furthermore, the terminal parts 341 to 345 are passed through the open parts 211, 221, 231, 241, and 251 to support the relay body 3. Therefore, the relay body 3 can be supported by the terminal member 2 with a good balance.

(3) The plate members 21 to 25 are made to extend over the mutually perpendicular XZ plane, YZ plane, and XY plane. Therefore, the plate members 21 to 25 can be made longer and the effect of reduction of operating noise can be raised.

Second Embodiment

Figure 7:
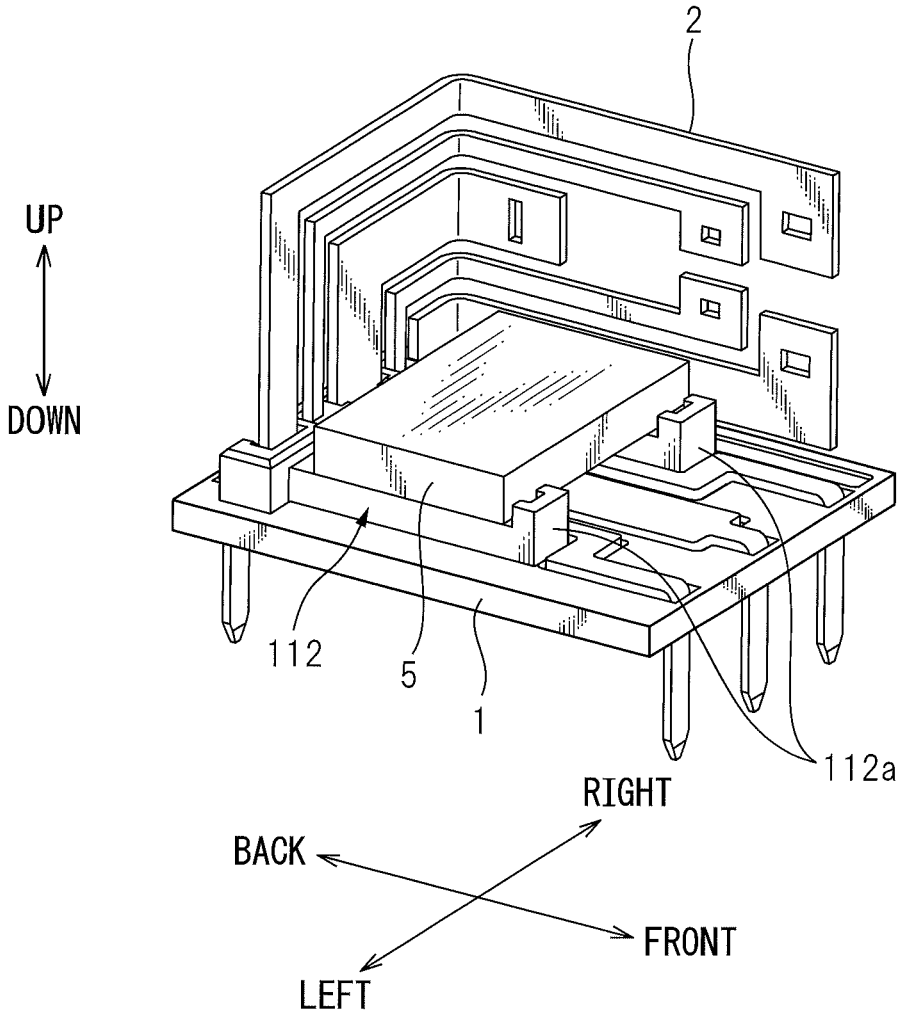
FIG. 7 is a perspective view which shows the configuration of important parts of an electromagnetic relay according to a second embodiment of the present invention.
Figure 8:
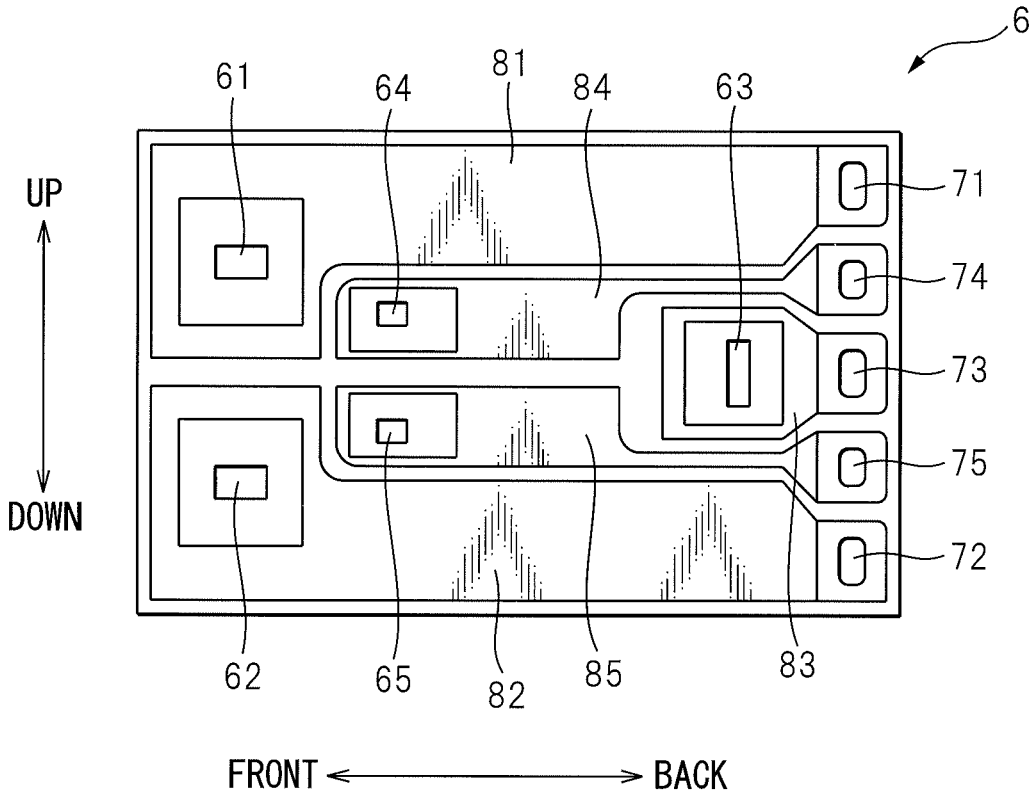
FIG. 8 is a view which shows an example of use of a flexible board for part of the terminal member.

Referring to FIG. 7 and FIG. 8, a second embodiment of the present invention will be explained. The second embodiment differs from the first embodiment in the point of the provision of a buffer material 5 in the clearance between the base member 1 and the relay body 3.

FIG. 7 is a perspective view of the main configuration of the electromagnetic relay 100 according to the second embodiment. Note that, in the figure, illustration of the relay body 3 and the cover 4 is omitted. The same portions as in FIG. 1 to FIG. 6 are assigned the same reference numerals. Below, the points of difference from the first embodiment will mainly be explained. At the top surfaces of the left and right second protruding parts 112 of the base member 1, a buffer material 5 of a substantially rectangular shape when viewed by a plan view is arranged. At the front end portions of the second protruding parts 112, projecting parts 112*a* which project out upward are provided. The buffer material 5 is restricted in position by the projecting parts 112*a*. Note that, the top surfaces of the projecting parts 112*a* are lower than the top surface of the buffer material 5. The buffer material 5 is comprised of rubber, urethane, etc. and has elasticity.

In this way, in the state with the buffer material 5 placed on the top surface of the base member 1, in the same way as the first embodiment, the relay body 3 is attached to the terminal member 2. In this case, the thickness of the buffer material 5 is the same extent as the clearance between the base member 1 and the relay body 3, and the top surface of the buffer material 5 contacts the bottom surface of the relay body 3. In this state, when the relay body 3 vibrates about the mounting part of the terminal member 2, the relay body 3 receives a reaction force from the buffer material 5 without contacting the base member 1. Therefore, it is possible to suppress the generation of the vibrating noise (chattering noise) which occurs at the time of contact of the relay body 3 and the base member 1. The buffer material 5 has the property of being resistant to transmission of noise. Therefore, even if the relay body 3 contacts the buffer material 5, the operating noise of the relay body 3 can be prevented from being transmitted through the buffer material 5 to the base member 1. Note that, it is also possible to make the thickness of the buffer material 5 smaller than the clearance between the base member 1 and the relay body 3 so as to provide a fine clearance between the buffer material 5 and the relay body 3.

In the above embodiment, the relay body 3 is made to contact the buffer material 5 so as to suppress vibrating noise. However, it is also possible to suppress vibrating noise by causing contact with the projecting parts 112*a* which stick out from the base member 1. In this case, it is also possible to increase the height of the projecting parts 112*a* from that of FIG. 7 to make the projecting parts 112*a* abut against the bottom surface of the relay body 3 and to support the bottom surface of the relay body 3 by the projecting parts 112*a*. As a result, the vibrating noise of the relay body 3 can be suppressed. In this case, although the operating noise of the relay body 3 is transmitted through the projecting parts 112*a* to the base member 1, the amount of transmission of the operating noise is small because the contact area between the relay body 3 and the projecting parts 112*a* is small. Note that, it is also possible to provide a fine clearance between the bottom surface of the relay body 3 and the projecting parts 112*a*. When raising the projecting parts 112*a*, the buffer material 5 can be omitted. However, the buffer material 5 may also be placed as it is.

When arranging a buffer material 5 between the base member 1 and the relay body 3 or when using projecting parts 112*a* to support the bottom surface of the relay body 3, part of the terminal member 2 may also be configured by the flexible board. For example, the right surface part 26 of the terminal member 2 may also be configured by the flexible board. FIG. 8 is a plan view which shows one example of the flexible board 6 in this case. The flexible board 6 is formed with through holes 61 to 65 at positions corresponding to the terminal parts 34 of the relay body 3. Furthermore, the back end portion of the flexible board 6 is formed with through holes 71 to 75 in the up-down direction corresponding to the plate members 21 to 25 at the back end portion 27 of the terminal member 2. The through holes 61 to 65 are electrically connected through circuit patterns 81 to 85 formed on the board to the through holes 71 to 75.

When assembling the electromagnetic relay 100, the end portions of the plate members 21 to 25 at the back surface part 27 of the terminal member 2 are inserted into the through holes 71 to 75 and soldered to connect them to the flexible board 6 and thereby form the terminal member 2. In the state where the terminal member 2 is attached to the base member 1, the terminal parts 341 to 345 of the relay body 3 are passed through the through holes 61 to 65 and soldered while the bottom surface of the relay body 3 is supported by the buffer material 5 or projecting parts 112*a* (FIG. 7). According to the thus configured electromagnetic relay body 100, the relay operating noise can be reduced by the flexible board 6. Note that, the flexible board 6 may also be provided at another portion of the terminal member 2 (for example, right surface part 26 or bottom surface part 28). If the relay body 3 can be supported stably by the terminal member 2, the buffer material 5 and the projecting parts 112*a* may be omitted.

In the above embodiment, the terminal member 2 is preferably made using a material with a high electroconductivity. Therefore, the terminal member 2 can be reduced in thickness and the vibration absorbing effect can be enhanced. By using a material which has a springiness for the terminal member 2 as well, the vibration absorbing effect can be enhanced. In the above embodiment, a binder is used to bond the cover 4 to the base member 1. As the binder, a urethane binder is preferably used. A urethane binder is softer than an epoxy resin-based binder. Therefore, by using the urethane binder as well, the vibration absorbing effect can be raised. Note that, it is also possible to similarly use a urethane binder at other bonding portions.

In the above embodiment, the plate members 21 to 25 which have the bent parts 20*a* and 20*b* are used to form the terminal member 2 along the mutually perpendicular XZ plane (first plane), YZ plane (second plane), and XY plane (third plane). However, any shape of the terminal member 2 is possible so long as having connecting parts which electrically connect to the relay body 3 (through holes 211, 221, 231, 241, and 251) and supporting the relay body 3 while providing a clearance between the base member 1 and the relay body 3 by the connecting parts. Although the contact part 33 of the relay body 3 is made one which has a first fixed contact 331, a second fixed contact 332, and a movable contact 333, the configuration of the contact part which opens and closes along with operation of the electromagnet 32 is not limited to this. The configuration of the electromagnetic relay body comprised of the relay body 3 is also not limited to the one explained above. Any configuration of the base member 1 is possible so long as supporting the terminal member 2.

According to the present invention, a clearance is provided between the base member and the electromagnetic relay body and a terminal member is used to support the electromagnetic relay body. Therefore, it is possible to absorb the operating noise of the relay etc. by the terminal member and obtain a sufficient noise suppression effect without increasing the reverberating sound at the time of relay operation and without degrading the heat radiating ability of the heat generating parts of the relay.

While the present invention has been described with reference to the preferred embodiments thereof, it will be understood, by those skilled in the art, that various changes and modifications may be made thereto without departing from the scope of the appended claims.

The invention claimed is:

1. An electromagnetic relay comprising:

an electromagnetic relay body having an electromagnet and a contact part, the contact part that opens and closes along with operation of the electromagnet, a terminal member supporting the electromagnetic relay body, and a base member supporting the terminal member, wherein the terminal member has a first surface, a second surface bent from the first surface in a perpendicular direction relative to the first surface, a third surface bent from the second surface in a perpendicular direction relative to the second surface, and a terminal part bent from the third surface in a perpendicular direction relative to the third surface, and the first surface, the second surface and the third surface are mutually perpendicular, and further wherein the terminal member has a connecting part electrically connected to the electromagnetic relay body at the first surface, and the electromagnetic relay body is supported by the connecting part while providing a clearance between the base member and the electromagnetic relay body.

2. The electromagnetic relay according to claim 1, wherein the terminal member is comprised of a plurality of plate members having the connecting part at one end portion and having the terminal part which passes through the base member at the other end portion, and the connecting part is electrically connected to a coil of the electromagnet or the contact part.

3. The electromagnetic relay according to claim 1, wherein a buffer material is interposed in the clearance between the base member and the electromagnetic relay body.

4. The electromagnetic relay according to claim 1, wherein a projecting part is provided on a surface of the base member facing the electromagnetic relay body toward the electromagnetic relay body.

5. The electromagnetic relay according to claim 1, further comprising:

a cover member surrounding the electromagnetic relay body and the terminal member, the cover member being bonded to the base member by a binder, wherein the binder is a urethane binder.

6. The electromagnetic relay according to claim 1, wherein the terminal member is partially comprised of a flexible board.

7. An electromagnetic relay comprising:

an electromagnetic relay body having an electromagnet, a contact part and terminals, the contact part that opens and closes along with operation of the electromagnet, a terminal member supporting the electromagnetic relay body, and a base member supporting the terminal member, wherein the terminal member has a first surface, a second surface bent from the first surface in a perpendicular direction relative to the first surface, a third surface bent from the second surface in a perpendicular direction relative to the second surface, and a terminal part bent from the third surface in a perpendicular direction relative to the third surface, and the first surface, the second surface and the third surface are mutually perpendicular, and further wherein the terminal member has a connecting part electrically connected to the electromagnetic relay body at the first surface, and the electromagnetic relay body is supported by the connecting part while providing a clearance between the base member and the electromagnetic relay body.

8. The electromagnetic relay according to claim 7, wherein the terminals are provided on one surface of the electromagnetic relay body to connect to the connecting part at the first surface of the terminal member.

9. An electromagnetic relay comprising:

a base member;

an electromagnetic relay body that includes:

an electromagnet that has terminals, and a contact that has terminals, and closes along with operation of the electromagnet; and terminal members provided on the base member, and supporting the electromagnet body, each terminal member has first surface, a second surface bent from the first surface in a perpendicular direction relative to the first surface, a third surface bent from the second surface in a perpendicular direction relative to the second surface, and a terminal part bent from the third surface in a perpendicular direction relative to the third surface, and the first surface, the second surface and the third surface are mutually perpendicular, wherein the each terminal member has a connecting part electrically connected to one of the terminals of the electromagnet or the contact at one end thereof at the first surface, and the terminal part is electrically connected to an electrical part outside the electromagnetic relay at the other end thereof, wherein the electromagnetic relay body is supported by the terminal members in a condition where a space is provided between the base member and the electromagnetic relay body.

10. The electromagnetic relay according to claim 9, wherein the number of the terminal members is equal to the number of the terminals of the electromagnet and the terminals of the contact.

* * * * *